US009790664B2

(12) United States Patent
Morita

(10) Patent No.: US 9,790,664 B2
(45) Date of Patent: Oct. 17, 2017

(54) SHOVEL HAVING AN ENGINE EQUIPPED WITH A SUPERCHARGER

(71) Applicant: SUMITOMO(S.H.I.) CONSTRUCTION MACHINERY CO., LTD., Tokyo (JP)

(72) Inventor: Kenji Morita, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 289 days.

(21) Appl. No.: 14/471,219

(22) Filed: Aug. 28, 2014

(65) Prior Publication Data

US 2015/0063967 A1 Mar. 5, 2015

(30) Foreign Application Priority Data

Sep. 5, 2013 (JP) ..... 2013-184474

(51) Int. Cl.

*E02F 3/42* (2006.01)
*E02F 9/22* (2006.01)
*F02B 37/12* (2006.01)

(52) U.S. Cl.

CPC ..... *E02F 9/2246* (2013.01); *E02F 3/425* (2013.01); *E02F 9/2282* (2013.01); *E02F 9/2292* (2013.01); *E02F 9/2296* (2013.01); *F02B 2037/122* (2013.01)

(58) Field of Classification Search

CPC ..... E02F 9/2246; E02F 3/425
USPC ..... 60/607
See application file for complete search history.

(56) References Cited

U.S. PATENT DOCUMENTS 5,468,126 A * 11/1995 Lukich ..... F02D 29/04 123/383
2002/0029772 A1* 3/2002 Isaac ..... F02D 41/0007 123/564
2002/0170291 A1* 11/2002 Shirakawa ..... F02B 37/22 60/602
2003/0121263 A1* 7/2003 Hidaka ..... F02B 37/24 60/602
2007/0205660 A1* 9/2007 Carswell ..... B60T 8/1761 303/139
2012/0036860 A1* 2/2012 Wettstein ..... F02C 1/08 60/772

FOREIGN PATENT DOCUMENTS

JP 2008-008188 1/2008
JP 2008-128107 6/2008
JP 2008-128107 A * 6/2008 ..... F02B 37/18
JP 2010-169242 8/2010

* cited by examiner

*Primary Examiner* — Jonathan Matthias
(74) *Attorney, Agent, or Firm* — IPUSA, PLLC

(57) ABSTRACT

A shovel includes a boom cylinder that drives a boom and an arm cylinder that drives an arm. A hydraulic pump supplies operating oil to the boom cylinder and the arm cylinder. An engine is connected to the hydraulic pump and equipped with a supercharger. The engine is controlled to maintain a revolution speed within a certain definite range. A controller controls a rotating speed of the supercharger. The controller performs a process of increasing the rotating speed of the supercharger so as to increase a supercharging pressure generated by the supercharger before a hydraulic load is applied to the engine.

11 Claims, 9 Drawing Sheets

SHOVEL HAVING AN ENGINE EQUIPPED WITH A SUPERCHARGER

CROSS-REFERENCE TO RELATED APPLICATION

The present application is based on priority claimed Japanese Patent Application No. 2013-184474 filed on Sep. 5, 2013, the entire contents of which are incorporated herein by reference.

BACKGROUND

Technical Field

The present invention relates to a shovel having an engine equipped with a supercharger.

Description of Related Art

In recent years, there are many cases where an engine equipped with a turbocharger (turbo supercharger) is used as an engine for a hydraulic shovel. The turbocharger can increase an engine's power by performing supercharge by introducing a pressure, which is generated by rotating a turbine using an exhaust gas of the engine, into an intake system of the engine.

Specifically, when a drive operation of a boom is started during an operation of a shovel, a hydraulic load is increased and also an engine load applied to an engine, which has maintained a fixed revolution speed till then, is increased. In response to such an increase in the engine load, the engine increases its output power by increasing a supercharging pressure (boost pressure) and an amount of fuel injection in order to maintain the engine revolution speed.

Especially, in order to quickly respond to an increase in the engine load, a conventional output control device increases, when an operation increasing the engine load is detected, a supercharging pressure of a turbocharger engine to control the engine to increase the engine power.

SUMMARY

According to an aspect of the present invention, there is provided a shovel including: a boom cylinder that drives a boom; an arm cylinder that drives an arm; a hydraulic pump that supplies operating oil to the boom cylinder and the arm cylinder; an engine connected to the hydraulic pump and equipped with a supercharger, the engine being controlled to maintain a revolution speed within a certain definite range; and a controller that controls a rotating speed of the supercharger, wherein the controller performs a process of increasing the rotating speed of the supercharger so as to increase a supercharging pressure generated by the supercharger before a hydraulic load is applied to the engine.

The object and advantages of the embodiments will be realized and attained by means of the elements and combinations particularly pointed out in the appended claims.

It is to be understood that both the foregoing general description and the following detailed description are exemplary explanatory only and are not restrictive of the invention, as claimed.

DETAILED DESCRIPTION

Figure 1:
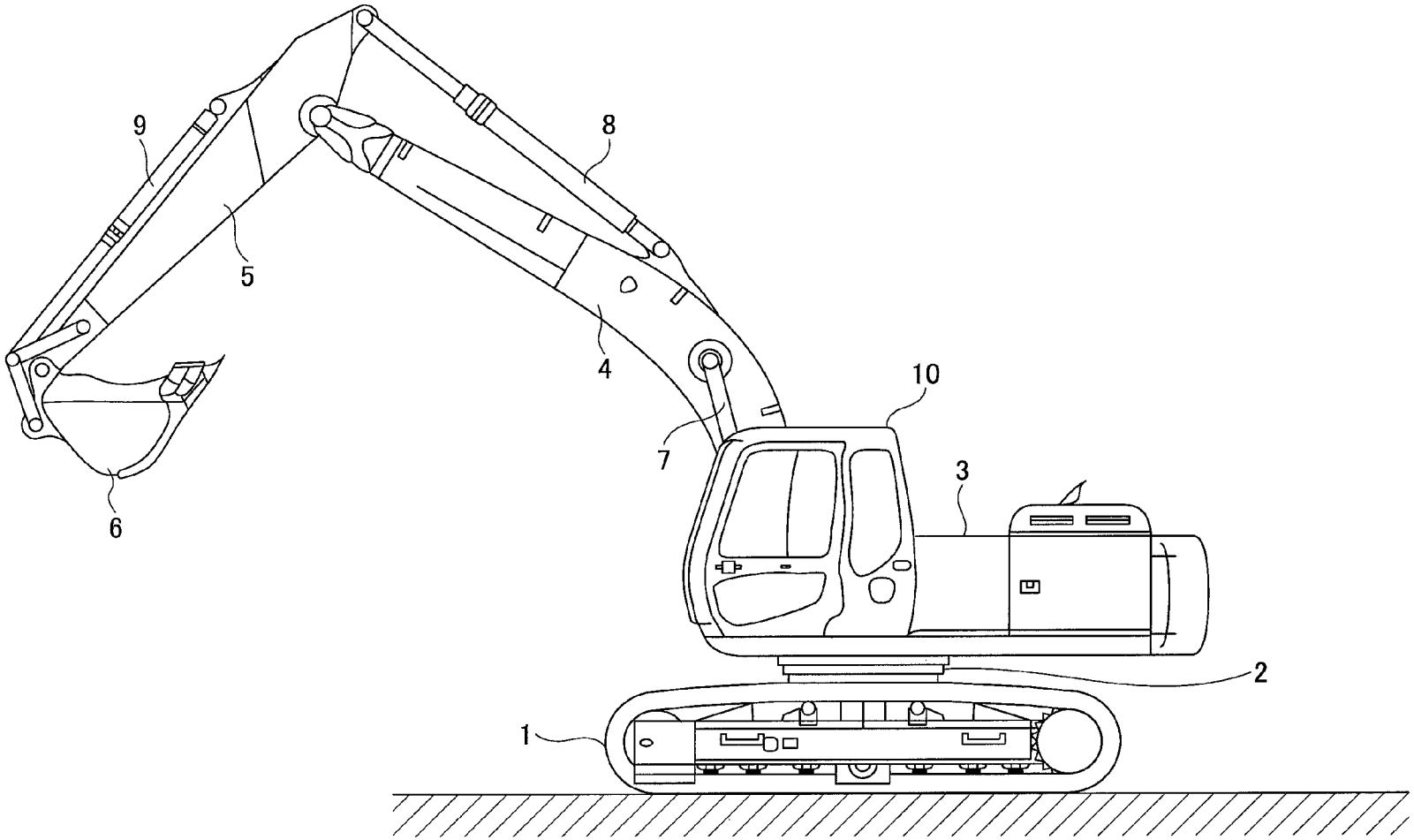
FIG. 1 is a side view of a shovel according to an embodiment of the present invention.

First, a description will be given, with reference to FIG. 1, of a shovel according to an embodiment of the present invention. FIG. 1 is a side view of the shovel according to the present embodiment. The shovel illustrated in FIG. 1 includes a lower running body 1 with a turning mechanism 2 and an upper turning body 3 that are mounted on the lower running body 1. A work attachment is attached to the upper turning body 3. The work attachment includes a boom 4, an arm 5 and a bucket 6. Specifically, the boom 4 is attached to the upper turning body 3, the arm 5 is attached to an extreme end of the boom 4, and the bucket 6 is attached to an extreme end of the arm 5. The boom 4, the aim 5 and the bucket 6 are hydraulically driven by a boom cylinder 7, an arm cylinder 8 and a bucket cylinder 9, respectively. The upper turning body 3 is provided with a cabin 10 and also mounted with a power source such as an engine 11 or the like.

Figure 2:
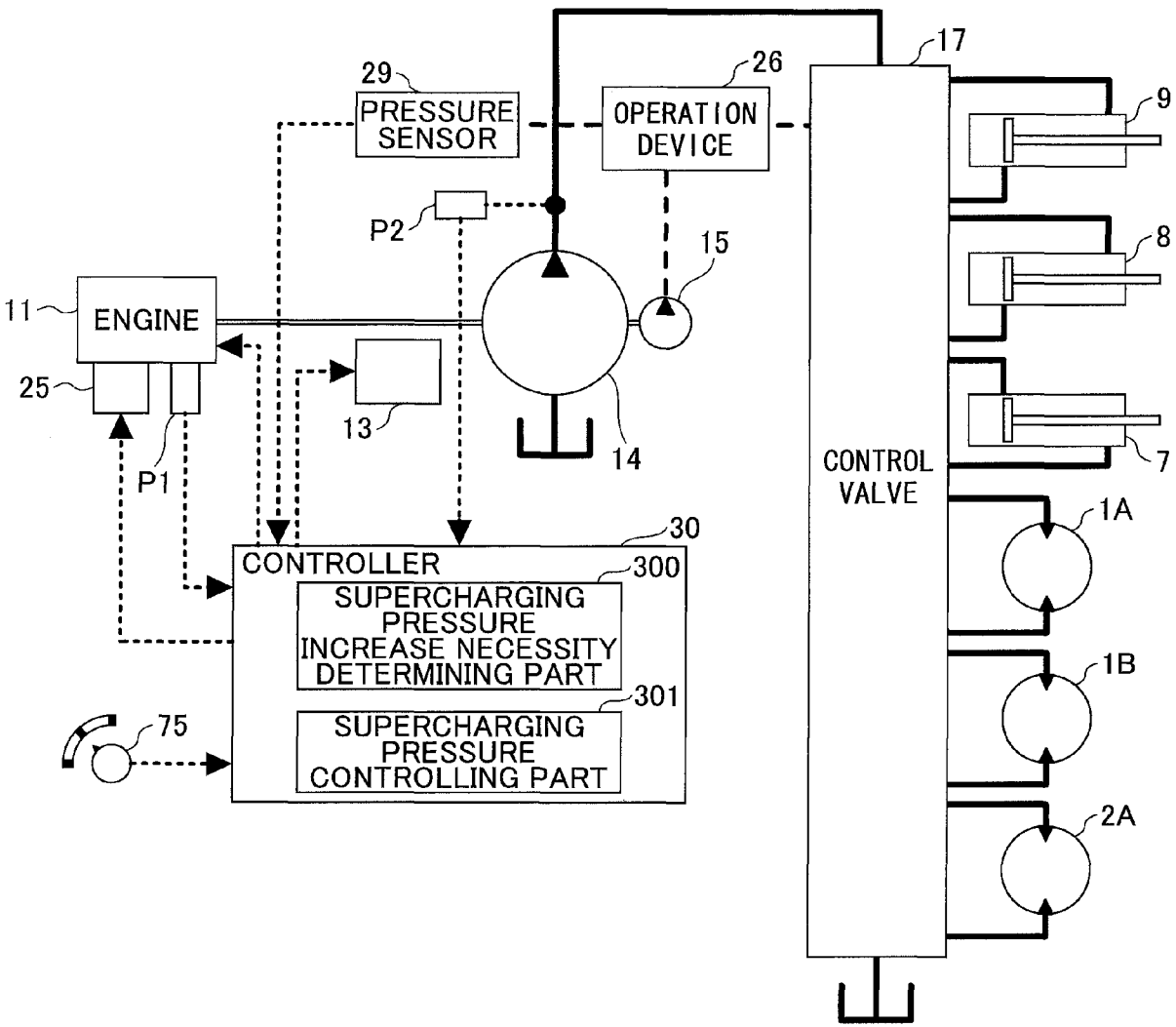
FIG. 2 is a block diagram illustrating a configuration of a drive system of the shovel illustrated in FIG. 1.

FIG. 2 is a block diagram illustrating a configuration of a drive system of the shovel illustrated in FIG. 1. In FIG. 2, double solid lines denote a mechanical drive system, bold solid lines denote high-pressure hydraulic lines, dashed lines denote pilot lines, and dotted lines denote electric control lines.

The drive system of the shovel mainly includes an engine 11, a regulator 13, a main pump 14, a pilot pump 15, a control valve 17, an operation device 26, a pressure sensor 29, a controller 30, an atmospheric pressure sensor P1, a discharge pressure sensor P2, a supercharger 25 and an engine revolution speed adjusting dial 75.

The engine 11 is a power source of the shovel, and is, for example, a diesel engine as an internal combustion engine operating to maintain a predetermined revolution speed. An output axis of the engine 11 is connected to an input axis of each of the main pump 14 and the pilot pump 15. In the present embodiment, the engine 11 is controlled to maintain a fixed revolution speed in a state where the output axis of the engine 11 is connected to the input axis of the main pump 14.

The regulator 13 is a device for controlling an amount of discharge of the main pump 14. The regulator 13 controls an amount of discharge of the main pump 14 by, for example, adjusting a swash plate inclination angle of the main pump 14 in response to a discharge pressure of the main pump 14 or a control signal from the controller 30.

The main pump 14 is a hydraulic pump for supplying operating oil to the control valve 17 through a high-pressure hydraulic line, and is, for example, a swash plate type variable capacity hydraulic pump.

The pilot pump 15 is a hydraulic pump for supplying operating oil to various hydraulically controlled devices through a pilot line, and is, for example, a fixed capacity hydraulic pump.

The control valve 17 is a hydraulic control device for controlling a hydraulic system in the shovel. The control valve 17 selectively supplies operating oil discharged by the main pump 14 to one or more of the boom cylinder 7, the arm cylinder 8, the bucket cylinder 9, a running hydraulic motor 1A (left), a running hydraulic motor 1B (right) and a turning hydraulic motor 2A. In the following description, the boom cylinder 7, the aim cylinder 8, the bucket cylinder 9, the running hydraulic motor 1A (left), the running hydraulic motor 1B (right) and the turning hydraulic motor 2A may be collectively referred to as "hydraulic actuators".

The supercharger 25 is a device for forcibly supplying air to the engine 11. For example, the supercharger 25 increases an intake pressure (generate a supercharging pressure) using exhaust gas exhausted from the engine 11. The supercharger 25 may be configured to generate a supercharging pressure using the rotation of the output axis of the engine 11. In the present embodiment, the supercharger 25 is a variable nozzle turbo, which is capable of controlling an amount of flow of exhaust gas in response to a revolution speed of the engine 11. The variable nozzle turbo will be described in detail later.

The operation apparatus 26 is used by an operator to operate the hydraulic actuator. The operation apparatus 26 supplies operating oil discharged by the pilot pump 15 to pilot ports of the flow control valve corresponding to the respective hydraulic actuators. The pressure (pilot pressure) of the operating oil supplied to each of the pilot ports corresponds to a direction of operation and an amount of operation of the respective lever or pedal (not illustrate in the figure) of the operation device 26 corresponding to the respective one of the hydraulic actuators.

The pressure sensor 29 is a sensor to detect an operation by the operator applied to the operation device 26. For example, the pressure sensor 29 detects, in the form of pressure, a direction of operation and an amount of operation applied to the lever or pedal of the operation device 26 corresponding the respective one of the hydraulic actuators, and outputs the value of the detected pressure to the controller 30. The operation contents of the operation device 26 may be detected by using a sensor other than the pressure sensor.

The controller 30 is a control device for controlling the shovel, and is constituted by, for example, a computer equipped with a CPU (Central Processing Unit), a RAM (Random Access Memory), a ROM (Read Only Memory), etc. The controller 30 reads a program corresponding to each of a supercharging pressure increase necessity determining part 300 and a supercharging pressure controlling part 301 from the ROM, and loads the read program to the RAM so as to cause the CPU to perform a process corresponding to the loaded program.

Specifically, the controller 30 receives the detected value output by the pressure sensor 29, and performs a process by each of the supercharging pressure increase necessity determining part 300 and the supercharging pressure controlling part 301 based on the detected value. Thereafter, the controller 30 appropriately outputs a control signal corresponding to a result of the process of each of the supercharging pressure increase necessity determining part 300 and the supercharging pressure controlling part 301 to the supercharger 25.

More specifically, the supercharging pressure increase necessity determining part 300 determines whether it is necessary to increase the supercharging pressure of the supercharger 25. If the supercharging pressure increase necessity determining part 300 determines that it is necessary to increase the supercharging pressure, the supercharging pressure controlling part 301 drives a supercharging pressure adjusting part 60 mentioned later in order to adjust the supercharging pressure of the supercharger 25.

The atmospheric pressure sensor P1 detects an atmospheric pressure and outputs a detected value to the controller 30. The discharge pressure sensor P2 detects a discharge pressure of the main pump 14 and outputs a detected value to the controller 30.

The engine revolution speed adjusting dial 75 is a device to change the revolution speed of the engine 11. In the present embodiment, the engine revolution speed adjusting dial 75 can change the revolution speed of the engine 11 stepwisely at three or more steps. The engine 11 is controlled to rotate constantly at a fixed revolution speed set by the engine revolution speed adjusting dial 75.

Figure 3:
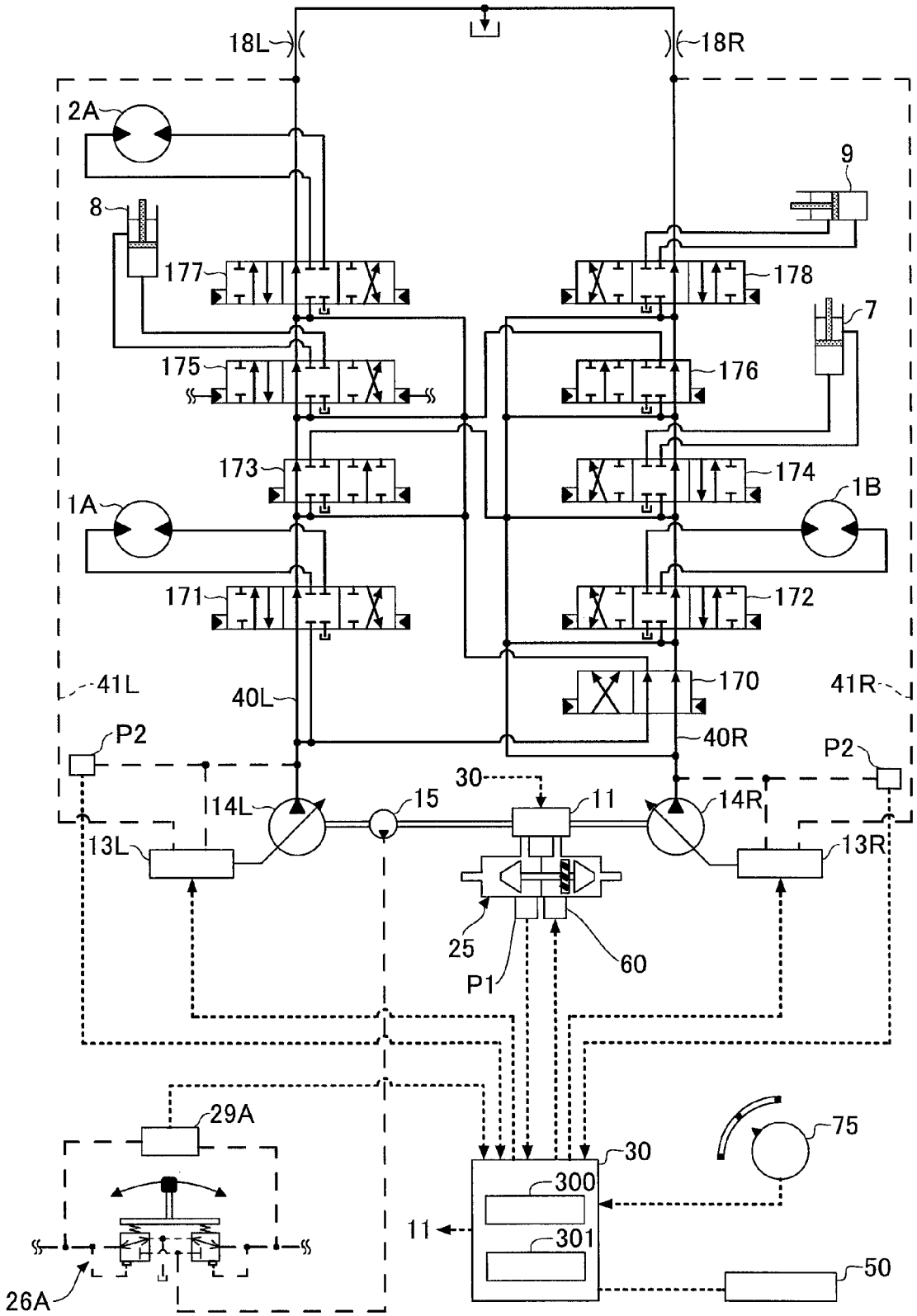
FIG. 3 is a circuit diagram of a hydraulic system of the shovel illustrated in FIG. 1.

A description is given, with reference to FIG. 3, of a hydraulic system mounted on the shovel illustrated in FIG. 1. FIG. 3 is a circuit diagram of a hydraulic system mounted on the shovel illustrated in FIG. 1. In FIG. 3, similar to FIG. 2, double solid lines denote a mechanical drive system, bold solid lines denote high-pressure hydraulic lines, dashed lines denote pilot lines, and dotted lines denote electric control lines.

In FIG. 3, the hydraulic system causes the operating oil to circulate from main pumps 14L and 14R to an operating oil tank through center bypass pipe lines 40L and 40R, respectively. It should be noted that the main pumps 14L and 14R together correspond to the main pump 14 illustrated in FIG. 2.

The center bypass pipe line 40L is a high-pressure hydraulic line passing through flow control valves 171, 173, 175 and 177 that are arranged in the control valve 17. The center bypass pipe line 40R is a high-pressure hydraulic line passing through flow control valves 170, 172, 174, 176 and 178 that are arranged in the control valve 17.

The flow control valves 173 and 174 are spool valves that change a flow direction of the operating oil to supply the operating oil discharged by the respective main pumps 14L and 14R to the boom cylinder 7 and discharge the operating oil in the boom cylinder 7 to the operating oil tank. It should be noted that the flow control valve 174 always operates when a boom operation lever 26A is operated. On the other hand, the flow control valve 173 operates only when the boom operation lever 26A is operated with an amount of operation larger than or equal to a predetermined amount of operation.

The flow control valves 175 and 176 are spool valves that change a flow direction of the operating oil to supply the operating oil discharged by the respective main pumps 14L and 14R to the arm cylinder 8 and discharge the operating oil in the arm cylinder 8 to the operating oil tank. It should be noted that the flow control valve 175 always operates when an arm operation lever (not illustrated in the figure) is operated. On the other hand, the flow control valve 176 operates only when the arm operation lever is operated with an amount of operation larger than or equal to a predetermined amount of operation.

The flow control valve 177 is a spool valve that changes a flow direction of the operating oil discharged by the main pump 14L to cause the operating oil to circulate through the turning hydraulic motor 2A.

The flow control valve 178 is a spool valve to supply the operating oil discharged by the main pump 14R to the bucket cylinder 9 and discharge the operating oil in the bucket cylinder 9 to the operating oil tank.

Regulators 13L and 13R control amounts of operating oil discharged by the main pumps 14L and 14R by adjusting inclination angles of swash plates of the main pumps 14L and 14R in response to discharge pressures of the main pumps 14L and 14R, respectively. It should be noted that the regulators 13L and 13R together correspond to the regulator 13 illustrated in FIG. 2. Specifically, the regulators 13L and 13R cause the amounts of discharge of the operating oil by adjusting inclination angles of the swash plates of the main pumps 14L and 14R when the discharge pressures of the main pumps 14L and 14R become higher than or equal to a predetermined value, respectively. This is to prevent an absorbing horsepower of the main pump 14, which is expressed by a product of a discharge pressure and an amount of discharge, from exceeding an output horsepower of the engine 11. This control is referred to as "whole horsepower control".

The boom operation lever 26A is an example of the operation device 26 illustrated in FIG. 2 that is used to operate the boom 4. The boom operation lever 26A is operated to introduce a control pressure corresponding to an amount of lever operation into either one of the left and right pilot ports of the flow control valve 174 by using the operating oil discharged by the pilot pump 15. The boom operation lever 26A is operated to introduce the operating oil into also one of the left and right pilot ports of the flow control valve 173.

A pressure sensor 29A is an example of the pressure sensor 29 illustrated in FIG. 2 that detects the contents of an operation, which the operator applies to the boom operation lever 26A, in the form of pressure and outputs the detected pressure value to the controller 30. The contents of an operation include, for example, a direction of a lever operation, an amount of a lever operation (a lever operation angle), etc.

Left and right travel levers (or pedals), an arm operation lever, a bucket operation lever and a turning operation lever (each of which is not illustrated in the figures) are operation devices for moving the lower running body 1, opening/closing the arm 5, opening/closing the bucket 6 and turning the upper turning body 3, respectively. Similar to the boom operation lever 26A, these operation devices are used to introduce a control pressure corresponding to an amount of lever operation (or an amount of pedal operation) into either one of the left and right pilot ports of the flow control valve corresponding to the hydraulic actuators by using the operating oil discharged by the pilot pump 15. Similar to the pressure sensor 29A, the contents of operation by an operator applied to the operation devices are detected by corresponding pressure sensors in the form of pressure, and the detected pressure values are output to the controller 30.

The controller 30 receives outputs of the pressure sensor 29A and the like, and outputs control signals to the regulators 13L and 13R when it is necessary to change amounts of discharge of the main pumps 14L and 14R.

A switch 50 is provided, for example, in the cabin 10 in order to change a process performed by the controller 30 to increase a supercharging pressure of the supercharger 25 (hereinafter, referred to as the "supercharging pressure increasing process") between an activated state and a stopped state. An operator can cause the supercharging pressure increasing process to be performed by operating the switch 50 to an ON position, and cause the supercharging pressure increasing process not to be performed by operating the switch 50 to an OFF position. Specifically, when the switch 50 is operated to the OFF position, the controller 30 prohibits execution of the processes of the supercharging pressure increase necessity determining part 300 and the supercharging pressure controlling part 301, and disables functions thereof.

A description is given below of a negative control used in the hydraulic system illustrated in FIG. 3.

The center bypass pipe lines 40L and 40R are equipped with negative control orifices 18L and 18R between the flow control valves 177 and 178 located at utmost downstream positions and the operating oil tank, respectively. The flow of the operating oil discharged by each of the main pumps 14L and 14R is restricted by the negative control orifices 18L and 18R. Then, the negative control orifices 18L and 18R generate a control pressure (hereinafter, referred to as "negative control pressure") for controlling the regulators 13L and 13R, respectively.

Negative control pressure pipe lines 41L and 41R indicated by dashed lines in FIG. 3 are pilot lines for transmitting negative control pressures generated at upstream positions of the negative control orifices 18L and 18R, respectively.

The regulators 13L and 13R control amounts of discharge of the main pumps 14L and 14R by adjusting inclination angles of the swash plates of the main pumps 14L and 14R in response to the negative control pressure, respectively. Additionally, the regulators 13L and 13R decrease the amounts of discharge of the main pumps 14L and 14R as the negative control pressures introduced therein are increased, and increase the amounts of discharge of the main pumps 14L and 14R as the negative control pressures introduced therein are decreased, respectively.

Specifically, as illustrated in FIG. 3, if none of the hydraulic actuators of the shovel is operated (hereinafter, referred to as the "waiting mode"), the hydraulic oil discharged by the main pumps 14L and 14R flows through the center bypass pipe lines 40L and 40R and reaches the negative control orifices 18L and 18R, respectively. Then, the flow of the operating oil discharged by the main pumps 14L and 14R increases the negative control pressure generated at upstream positions of the negative control orifices 18L and 18R, respectively. As a result, the regulators 13L and 13R cause the amount of discharge of the main pumps 14L and 14R to decrease to an allowable minimum amount of discharge, respectively, so that the discharged operating oil suppresses a pressure loss (pumping loss) when the discharged operating oil passes through the center bypass pipe lines 40L and 40R.

On the other hand, if any one of the hydraulic actuators is operated, the hydraulic oil discharged by the main pumps 14L and 14R flows into the operated hydraulic actuator through the flow control valve corresponding to the operated hydraulic actuator. Then, the flow of the operating oil discharged by the main pumps 14L and 14R causes an amount of the operating oil reaching the negative control orifices 18L and 18R to be reduced or to become zero so as to decrease the negative control pressure generated at upstream positions of the negative control orifices 18L and 18R, respectively. As a result, the regulators 13L and 13R cause the amount of discharge of the main pumps 14L and 14R to increase, respectively, so as to circulate a sufficient amount of operating oil to the operated hydraulic actuator, which assures driving the operated hydraulic actuator.

According to the above-mentioned configuration and arrangement, the hydraulic system illustrated in FIG. 3 is capable of suppressing waste energy consumption in the main pumps 14L and 14R in the waiting mode. It should be noted that the waste energy consumption contains pumping loss generated by the operating oil discharged by the main pumps 40L and 40R when flowing through the center bypass pipe lines 40L and 40R.

Moreover, when operating the hydraulic actuators, the hydraulic system illustrated in FIG. 3 makes it possible to surely supply a necessary and sufficient amount of operating oil from the main pumps 14L and 14R to the hydraulic actuators to be operated.

Figure 4A:
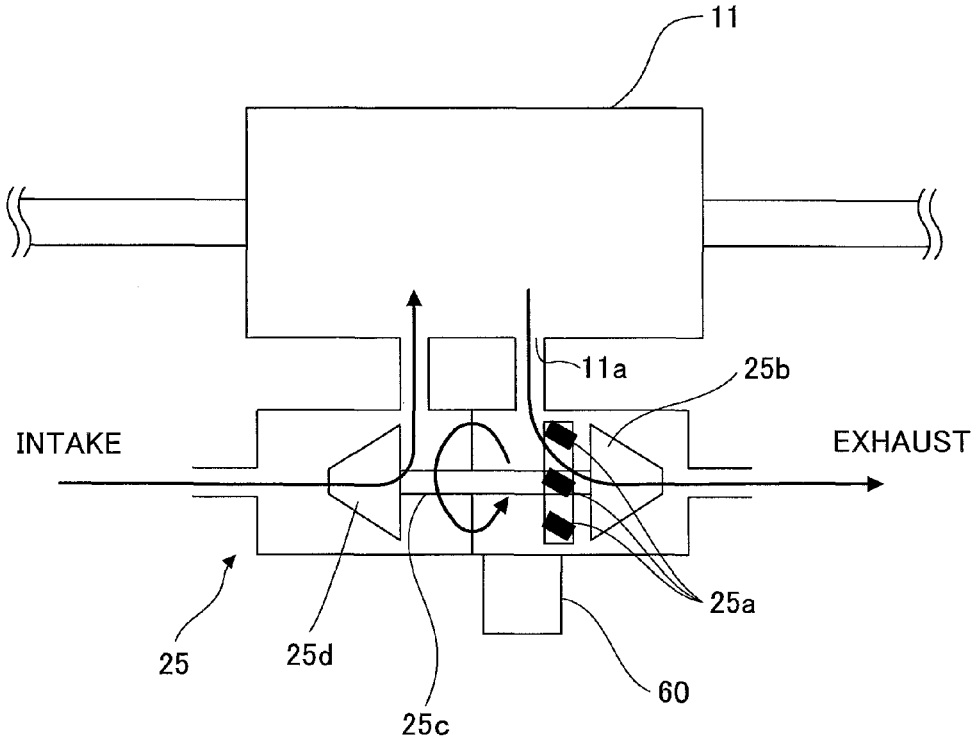
FIGS. 4A and 4B are illustrations of a structure of a supercharger incorporated in the shovel illustrated in FIG. 1.
Figure 4B:
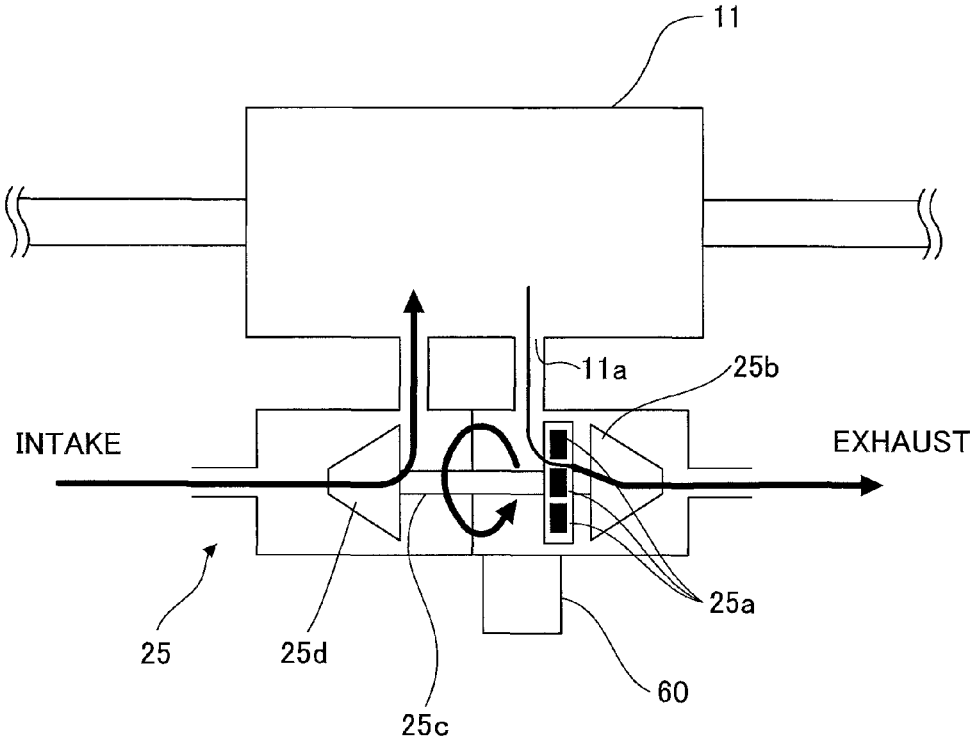

A description is given, with reference to FIGS. 4A and 4B, of the function of the variable nozzle turbo 25 as a supercharger. FIGS. 4A and 4B are illustrations of a structure of the variable nozzle turbo 25.

The variable nozzle turbo 25 mainly includes nozzle vanes 25*a*, turbine blades 25*b*, a turbo shaft 25*c* and compressor blades 25*d*.

The nozzle vanes 25*a* are members for controlling the amount of the flow of exhaust gas flowing from an exhaust port 11*a* of the engine 11 to the turbine blades 25*b*. In the present embodiment, the nozzle vanes 25*a* are controlled by a nozzle actuator 60 as a supercharging pressure adjusting part so that a degree of opening (opening area) of the nozzle is increased or decreased.

The turbine blades 25*b* are members that rotate by receiving exhaust gas of the engine 11. The turbine blades 25*b* are coupled to the compressor blades 25*d* via the turbo shaft 25*c*. Thus, the rotation of the turbine blades 25*b* is transmitted to the compressor blades 25*d* via the rotation of the turbo shaft 25*c*.

The compressor blades 25*d* are members that compress outside air and supply the compressed air to an intake port of the engine 11. The compressor blades 25*b* rotate together with the turbine blades 25*b* in order to force outside air to flow into the intake port of the engine 11.

The nozzle actuator 60 is an example of a supercharging pressure adjusting part. The nozzle actuator 60 simultaneously controls the opening degrees of the plurality of nozzle vanes 25*a* by simultaneously driving the plurality of nozzle vanes 25*a*.

Specifically, the nozzle actuator 60 drives the nozzle vanes 25*a* so that a degree of opening of the nozzle (hereinafter, may be referred to as nozzle opening degree) increases as a revolution speed of the engine 11 increases. FIG. 4A illustrates the variable nozzle turbo 25 in a state where the engine revolution speed is relatively high and the nozzle opening degree is relatively large. In this case, an exhaust pressure of the exhaust gas flowing through the nozzle vanes 25*a* is maintained at a pressure lower than that in a case where the nozzle opening degree is relatively small, and also a relative flow velocity of the exhaust gas flowing through the turbine blades 25*b* is maintained at a relatively low velocity. It should be noted that the relative flow velocity of the exhaust gas passing through the turbine blades 25*b* means a difference between the velocity of the exhaust gas passing through the exhaust port 11*a* of the engine 11 and the velocity of the exhaust gas passing through the turbine blades 25*b*.

On the other hand, FIG. 4B illustrates the variable nozzle turbo 25 in a state where the engine revolution speed is relatively low and the nozzle opening degree is relatively small. In this case, an exhaust pressure of the exhaust gas passing through the nozzle vanes 25*a* is maintained at a pressure higher than that in a case where the nozzle opening degree is large, and also a relative flow velocity of the exhaust gas passing through the turbine blades 25*b* is maintained at a relatively high velocity. As a result, even if the velocity of exhaust gas passing through the exhaust port 11*a* of the engine 11 is the same, the relative flow velocity of the exhaust gas passing through the turbine blades 25*b* becomes large, and a rotating speed of the turbine blades 25*b* is also increased. As a result, the compressor blades 25*d* cause the supercharging pressure, thereby supplying a larger amount of air to the intake port of the engine 11.

It should be noted that, in FIG. 4A, the state where the relative velocity of the exhaust gas passing through the turbine blades 25*b* is relatively low because flow paths between the nozzle vanes 25*a* are relatively wide is indicated by the solid and thin arrow. Additionally, in FIG. 4A, the state where the rotating speed of the turbo shaft 25*c* is relatively small is indicated by the solid and thin rotating arrow, and the state where the flow velocity of the air passing through the compressor blades 25*d* is relatively low is indicated by the solid and thin arrow. On the other hand, in FIG. 4B, the state where the relative velocity of the exhaust gas passing through the turbine blades 25*b* is relatively high because flow paths between the nozzle vanes 25*a* are relatively narrow as indicated by the solid and bold arrow. Additionally, in FIG. 4B, the state where the rotating speed of the turbo shaft 25*c* is relatively large is indicated by the solid and thin rotating arrow, and the state where the flow velocity of the air passing through the compressor blades 25*d* is relatively high is indicated by the solid and bold arrow. Hereinafter, the control of the nozzle opening degree corresponding to the engine revolution speed by the above-mentioned nozzle actuator 60 is referred to as the "normal control". According to the normal control, the controller 30 is capable of improving a supercharge efficiency when the engine revolution speed is low, and reducing the exhaust pressure when the engine revolution speed is high.

It should be noted that the engine 11 may be equipped with a revolution speed sensor as a sensing means for detecting an engine revolution speed. The controller 30 may perform a so-called fixed revolution speed control, which maintains the engine revolution speed at a predetermined value within a certain definite range based on the detected engine revolution speed. In this case, a control loop such as a speed (number of revolutions) feedback control may be constructed. According to such a structure, if a difference (deviation) between a target engine revolution speed and the detected engine revolution speed is generated due to a decrease in the engine revolution speed, a fuel injection amount is increased and the engine revolution speed is maintained. Instead of the engine revolution speed, a revolution per minute (rotating speed) of a motor generator connected to the engine 11 may be used.

If the nozzle actuator 60 determines that it is necessary for the supercharging pressure increase necessity determining part 300 to increase the supercharging pressure in addition to the normal control, the nozzle actuator 60 adjusts a nozzle opening degree A to be a supercharging pressure increasing time nozzle opening degree As in response to the control signal output by the controller 30. Hereinafter, the control of the nozzle opening degree by the nozzle actuator 60 is referred to as the "supercharging pressure increasing control".

More specifically, the supercharging pressure increase necessity determining part 300 determines that it is necessary to increase the supercharging pressure when the shovel is located on a high-altitude ground (high-altitude place) and also operated in the waiting mode. Then, the supercharging pressure control part 301 outputs the control signal to the nozzle actuator 60 so that the nozzle opening degree A of the nozzle vanes 25*a* is adjusted to the supercharging pressure increasing time nozzle opening degree As.

Figure 5:
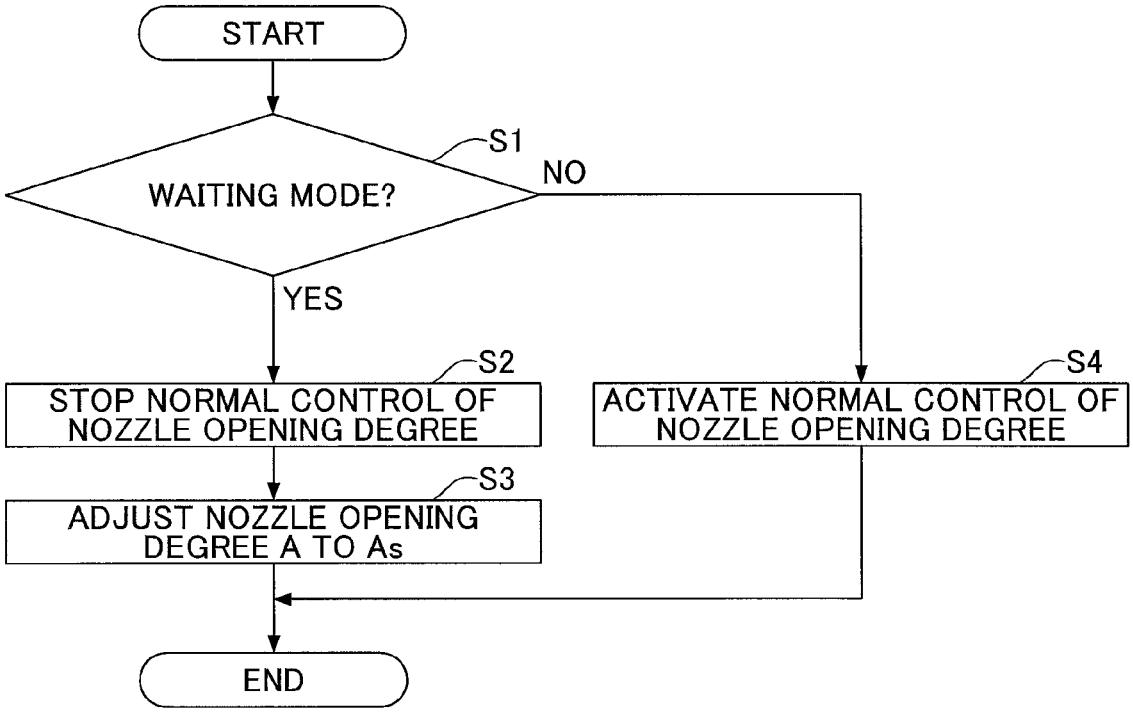
FIG. 5 is a flowchart of a supercharging pressure increasing process.

A description is given below, with reference to FIG. 5, of a process of increasing a supercharging pressure, if it is necessary, which is performed by the controller 30 of the shovel according to the present embodiment. Hereinafter, the process of increasing a supercharging pressure is referred to as the "supercharging pressure increasing process". FIG. 5 is a flowchart of the supercharging pressure increasing process. The controller 30 repeatedly performs the supercharging pressure increasing process at a predetermined period. According to the present embodiment, when the shovel is in an environment of a high-altitude place or the like where the atmospheric pressure is lower than a normal environment, the switch 50 van be manually operated to the ON position, and, thereby, the controller 30 can effectively activate the supercharging pressure increase necessity determining part 300 and the supercharging pressure controlling part 301.

First, the supercharging pressure increase necessity determining part 300 of the controller 30 determines whether the shovel is in the waiting mode (step S1). In the present embodiment, the supercharging pressure increase necessity determining part 300 determines whether the shovel is in the waiting mode based on whether the discharge pressure of the main pump 14 is higher than or equal to a predetermined pressure. For example, the supercharging pressure increase necessity determining part 300 determines that the shovel is in the waiting mode if the discharge pressure of the main pump 14 is lower than the predetermined pressure. The supercharging pressure increase determining part 300 may determine whether the shovel is in the waiting mode based on a pressure of the hydraulic actuators.

If the supercharging pressure increase necessity determining part 300 determines that the shovel is in the waiting mode (no hydraulic load exists) (YES in step S1), the controller 30 stops the normal control of the nozzle opening degree (step S2). Then the controller 30 activates the supercharging pressure increasing process to adjust the nozzle opening degree A of the nozzle vanes 25*a* to the supercharging pressure increasing time nozzle opening degree As, which is smaller than a nozzle opening degree at a time of the normal control (step S3). In the present embodiment, the supercharging pressure controlling part 301 of the controller 30 outputs the control signal to the nozzle actuator 60. Upon receipt of control signal, the nozzle actuator 60 interrupts the normal control of a nozzle opening degree. Then, the nozzle opening degree of the nozzle vanes 25*a* is reduced to the supercharging pressure increasing time nozzle opening degree As. Thereby, the relative velocity of the exhaust gas passing through the turbine blades 25*b* is increased to increase the rotating speed of the turbo shaft 25*c*, which increases the velocity of air flow passing through the compressor blades 25*d*, thereby increasing the supercharging pressure.

On the other hand, if the supercharging pressure increase determining part 300 determines that the shovel is not in the waiting mode (a hydraulic load exists) (NO in step S1), the controller 30 stops the supercharging pressure increasing control of the nozzle opening degree, and activates the normal control of the nozzle opening degree (step S4). Then, the controller 30 varies the nozzle opening degree A of the nozzle vanes 25*a* in response to an engine revolution speed.

As mentioned above, the controller 30 increases a supercharging pressure when the waiting mode is set. Accordingly, the controller 30 can increase a supercharging pressure beforehand by a predetermined width prior to an increase in the hydraulic load due to an external force. As a result even when the supercharging pressure cannot be increased quickly due to a low atmospheric pressure, a supercharging pressure corresponding to an increasing hydraulic load can be generated before a decrease in the engine revolution speed (a decrease in workability) or an engine stop occurs.

Figure 6:
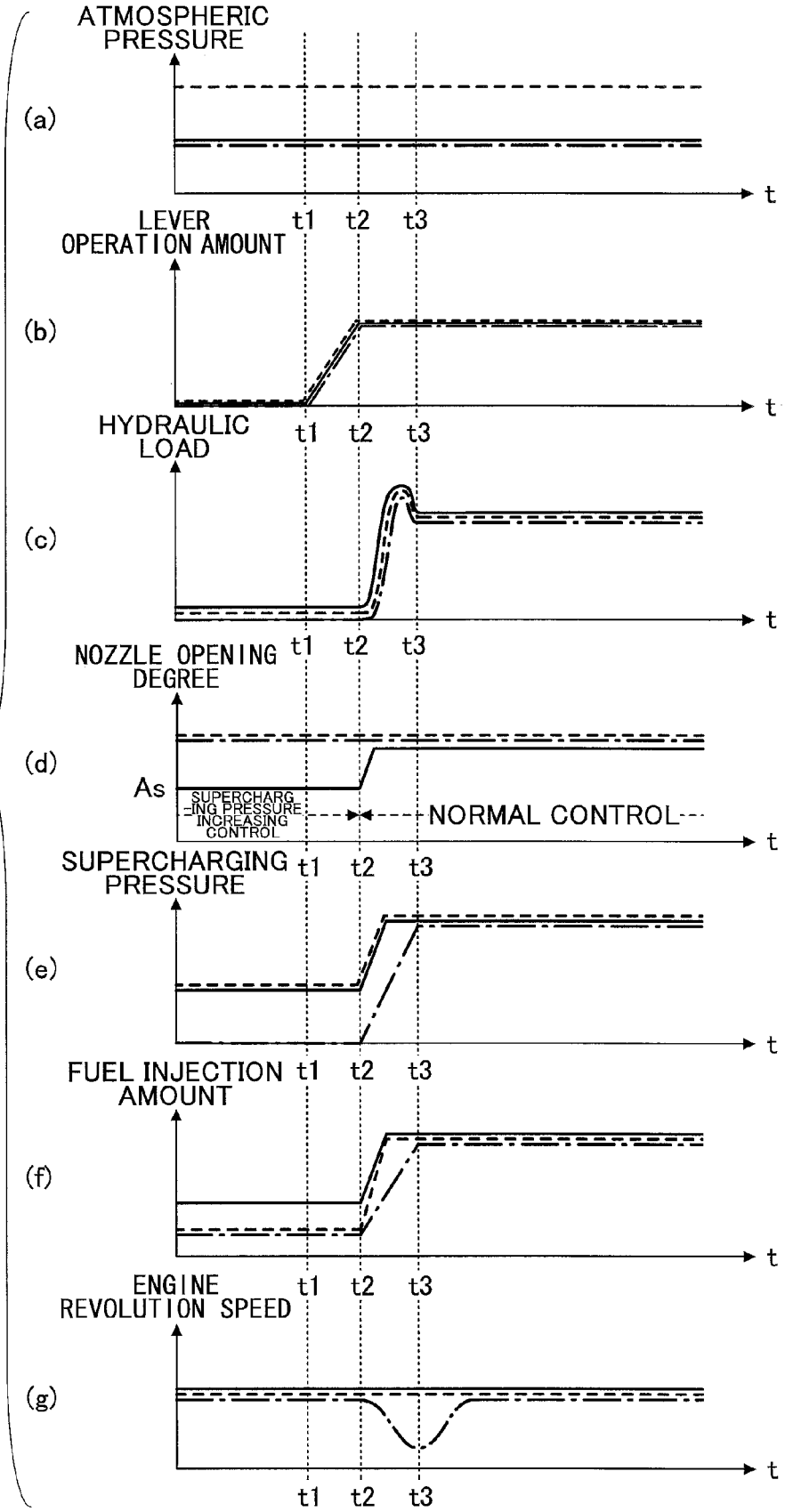
FIGS. 6(*a*)-6(*g*) are time charts of temporal transitions of various physical amounts when performing the supercharging pressure increasing process.

A description is given, with reference to FIGS. 6(*a*)-6(*g*), of temporal transitions of various physical amounts when performing the supercharging pressure increasing process. FIGS. 6(*a*)-6(*g*) illustrate temporal transitions of various physical amounts. FIG. 6(*a*) illustrates a temporal transition of an atmospheric pressure, 6(*b*) illustrates a temporal transition of a lever operation amount, 6(*c*) illustrates a temporal transition of a hydraulic load (absorbing horsepower), 6(*d*) illustrates a temporal transition of a nozzle opening degree, 6(*e*) illustrates a temporal transition of a supercharging pressure, 6(*f*) illustrates a temporal transition of a fuel injection amount, and 6(*g*) illustrates a temporal transition of an engine revolution speed. The transitions indicated by dashed lines in FIGS. 6(*a*)-6(*g*) illustrate transitions when the shovel is located on a low-altitude ground (in an environment where the atmospheric pressure is relatively high) and the supercharging pressure increasing process is not performed. The transitions indicated by single-dashed chain lines in FIGS. 6(*a*)-6(*g*) illustrate transitions when the shovel is located on a high-attitude ground (in an environment where the atmospheric pressure is relatively low) and the supercharging pressure increasing process is not performed. The transitions indicated by solid lines in FIGS. 6(*a*)-6(*g*) illustrate transitions when the shovel is located on a high-attitude ground (in an environment where the atmospheric pressure is relatively low) and the supercharging pressure increasing process is performed. The transitions indicated by these three types of lines are provided for the sake of easy explanation of the effects of the supercharging pressure increasing process. Specifically, if the shovel is in an environment such as a high-altitude ground where the atmospheric pressure is relatively low and when the supercharging pressure increasing process is not performed, if an attempt is made to increase a supercharging pressure at a time when an increase in a hydraulic load is detected, the supercharging pressure cannot be increased in the same manner as in an environment where then atmospheric pressure is relatively high, which may cause a shortage of engine output and cause the engine to stop. On the other hand, when the supercharging pressure increasing process is performed in an environment where the atmospheric pressure is relatively low, a shortage of engine output is prevented from occurring in the shovel.

In the present embodiment, it is assumed that a lever operation is performed to move the arm 5 at a time t1 in order to perform, for example, an excavating operation.

First, for the sake of comparison, a description is given of the temporal transitions of the various physical amounts in the case where the shovel is located on a lowland (in an environment where the atmospheric pressure is relatively high) and the supercharging pressure increasing process is not performed and the case where the shovel is located on a highland (in an environment where the atmospheric pressure is relatively low) and the supercharging pressure increasing process is not performed.

In order to perform an excavating operation at time t1, an operation of an arm operation lever is started. An amount of operation of the arm operation lever (an angle of inclining the arm operation lever) is increased from time t1 till time t2, and is maintained at a fixed amount after time t2. That is, the arm operation lever is operated and inclined from time t1, and the inclination of the arm operation lever is maintained at a fixed amount at time t2.

The discharge pressure of the main pump 14 starts to rise due to a load applied to the arm 5 and the hydraulic load to the main pump 14 starts to rise at time t2 at which the arm operation lever is inclined to the utmost. That is, the hydraulic load to the main pump 14 starts to rise near time t2 as illustrated by the dashed line and the single-dashed chain line in the graph of FIG. 6(*a*). The hydraulic load of the main pump 14 corresponds to a load to the engine 11, and, thus, the load to the engine 11 also rises together with the hydraulic load of the main pump 14. As a result, when the shovel is located on a lowland (in an environment where an atmospheric pressure is relatively low), the revolution speed of the engine 11 is maintained at a predetermined revolution speed as indicated by the dashed line in the graph of FIG. 6-(*g*). On the other hand, when the shovel is located on a highland (in an environment where the atmospheric pressure is relatively high), the revolution speed of the engine 11 largely decreases from a time when time t2 is passed as illustrated by the single-dashed chain line in the graph of FIG. 6(*g*). This is because the supercharging pressure becomes low in the environment where the atmospheric pressure is relatively low, which prevents achieving an engine output corresponding to the load to the engine 11.

Specifically, if a load to the engine 11 is increased, normally, a control of the engine 11 is activated to increase a fuel injection amount. Thereby, the supercharging pressure is also increased and the output of the engine 11 is also increased. However, during the time when the supercharging pressure is low, an increase in the fuel injection amount is restricted, and the combustion efficiency of the engine 11 cannot be increased sufficiently. As a result, the engine output corresponding to the load to the engine 11 cannot be achieved, which decreases the revolution speed of the engine 11.

Thus, the controller 30 increases the supercharging pressure before the lever operation is performed by performing the supercharging pressure increasing process when the shovel is located on a highland (in an environment where the atmospheric pressure is relatively low).

A description is given below, with reference to FIGS. 6(*a*)-6(*g*), of the temporal transitions of the various physical amounts when the shovel is located on a highland (in an environment where the atmospheric pressure is relatively low) and the supercharging pressure is performed. In FIGS. 6(*a*)-6(*g*), the temporal transitions of the various physical amounts, when the shovel is located on a highland (in an environment where the atmospheric pressure is relatively low) and the supercharging pressure is performed, are indicated by solid lines. In the case of FIGS. 6(*a*)-(*g*), the shovel is in a no-load state and also in the waiting mode until time t1.

An operation of the arm operation lever is started at time t1 in order to perform an excavation operation. The amount of operation of the arm operation lever (an angle of inclining the arm operation lever) is increased from time t1 until time t2, and is maintained at constant at time t2. That is, the arm operation lever is operated an inclined from time t1 and the inclination of the arm operation lever is maintained at a constant inclination at time t2. When the operation of the arm operation lever is started at time t1, the arm 5 begins to move, and the arm operation lever is inclined to the utmost at time t2.

When performing the supercharging pressure increasing process, the controller 30 adjusts the nozzle operating degree A of the nozzle vanes 25*a* to the supercharging pressure increasing time nozzle opening degree As, which is smaller than a nozzle opening degree in the normal control before time t1, that is, before the lever operation is performed. Thus, the supercharging pressure is at a relatively high state as the same as the case where the shovel is located on a lowland (in an environment where an atmospheric pressure is relatively high). Additionally, the supercharging pressure is in a state where the arm operation lever can be raised immediately at time t2 at which the arm operation lever is inclined to the utmost. When the hydraulic load of the main pump 14 rises at time t2, the controller 30 determines that the shovel is not in the waiting mode, and stops the supercharging pressure increasing control of a nozzle opening degree to activate the normal control. As a result, the nozzle opening degree is controlled to a value corresponding to the engine revolution speed. It should be noted that although the nozzle opening degree in the normal control is illustrated to transit at a fixed value for the sake of clarification, in practice, the nozzle opening degree varies in response to the engine evolution speed.

As mentioned above, the supercharging pressure can be increased immediately at time t2 at which the hydraulic load starts to rise by adjusting the nozzle opening degree A of the nozzle vanes 25*a* to the supercharging pressure increasing time nozzle opening degree As, which is smaller than the nozzle opening degree in the normal control.

After time t2 has passed, the hydraulic load rises and the load to the engine 11 is increased. Thus, an instruction to further increase the fuel injection amount is issued, and, thereby, the fuel consumption gradually increases. An amount of increase of the fuel consumption corresponds to only the increase in the hydraulic load. This is because the engine revolution speed has already been maintained at a predetermined revolution speed and there is no need to consume additional fuel to raise the engine revolution speed. Additionally, the engine 11 is in a state where engine output can be efficiently increased at the time t3 because the supercharging pressure has been raised to a pressure value higher than or equal to the predetermined pressure value.

As mentioned above, the supercharging pressure can be increased before the time at which the hydraulic load starts to rise by adjusting the nozzle opening degree A of the nozzle vanes 25*a* to the supercharging pressure increasing time nozzle opening degree As, which is smaller than the nozzle opening degree in the normal control, before a lever operation is performed.

Additionally, as mentioned above, in an environment where the atmospheric pressure is relatively high, the supercharging pressure is already in a relatively high state (refer to the dashed line in FIG. 6(*e*)) even if the supercharging pressure increasing process is not performed.

Accordingly, if the supercharging pressure is not performed, the variable nozzle turbo 25 is in a state where the supercharging pressure can be rapidly increased. Additionally, the engine 11 is in a state where a drive power corresponding to a hydraulic load due to an external force can be supplied without causing a decrease in the engine revolution speed (a decrease in workability) or causing the engine to stop.

However, in an environment in which the atmospheric pressure is relatively low, if the supercharging pressure increasing process is not performed, the supercharging pressure is in a relatively low state (refer to the single-dashed chain line in FIG. 6(*e*)) also at time t2. Additionally, the variable nozzle turbo 25 cannot rapidly increase the supercharging pressure because the atmospheric pressure is relatively low. Specifically, the variable nozzle turbo 25 cannot achieve a sufficient supercharging pressure until time t3 is reached, and the engine 11 cannot sufficiently increase the fuel injection amount.

As a result, the engine 11 cannot output a drive power necessary for maintaining the engine revolution speed at a fixed revolution speed. Thus, the engine revolution speed is decreased, and, there may be a case where the engine revolution speed cannot be increased, which causes the engine 11 to stop.

Thus, in an environment in which the atmospheric pressure is relatively low, the controller 30 adjusts the nozzle opening degree of the nozzle vanes 25*a* to the supercharging pressure increasing time nozzle opening degree As, which is smaller than the nozzle opening degree in the normal control, before time t1, that is, before a lever operation is performed by performing the supercharging pressure increasing process.

As a result, even in an environment in which the atmospheric pressure is relatively low, the variable nozzle turbo 25 is in a state where the supercharging pressure can be rapidly increased similar to the environment in which the atmospheric pressure is relatively high. Additionally, the engine 11 is in a state where a drive power corresponding to a hydraulic load due to an external force can be supplied without causing a decrease in the engine revolution speed (a decrease in workability) or causing the engine to stop.

In this case, when the arm 5 is brought into contact with the ground at time t2, the hydraulic load increases in response to an increase in a reaction force of the excavating operation. Then, the load to the engine 11 is increased in response to the increase in the hydraulic load corresponding to the absorbing horsepower of the main pump 14. At this time, because the engine 11 maintains the predetermined engine revolution speed, the supercharging pressure can be rapidly increased by the variable nozzle turbo 25.

Thus, if the atmospheric pressure is relatively low, the controller 30 maintains the supercharging pressure at a relatively high level by setting the nozzle opening degree to be small before a lever operation is performed, and can increase the supercharging pressure without delay after a lever operation is performed. As a result, when a lever operation is performed, the engine revolution speed is prevented from being decreased and the engine 11 is prevented from being stopped.

Figure 7:
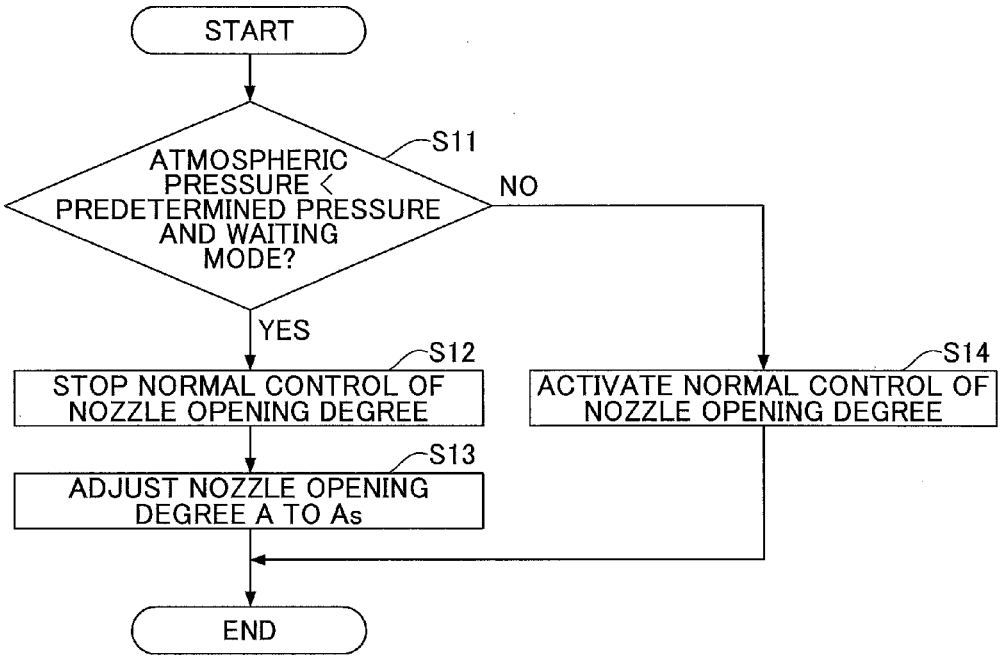
FIG. 7 is a flowchart of another supercharging pressure increasing process.

A description is given below, with reference to FIG. 7, of another example of the supercharging pressure increasing process. FIG. 7 is a flowchart of another example of the supercharging pressure increasing process according to the present embodiment. In the supercharging pressure increasing process illustrated in FIG. 7, the determination condition of step S11 differs from the determination condition of step S1 in the supercharging pressure increasing process of FIG. 5, but steps S12 to S14 are the same as steps S2 to S4 in the supercharging pressure increasing process of FIG. 5. Thus, a description will be given of step S11 in detail, and descriptions of other steps will be omitted. Additionally, the switch 50 is omitted in the present embodiment, and the controller 30 is capable of always effectively activating the supercharging pressure increase necessity determining part 300 and the supercharging pressure controlling part 301.

In step S11, the supercharging pressure increase necessity determining part 300 determines whether the shovel is in the waiting mode and the atmospheric pressure around the shovel is lower than a predetermined pressure. In the present embodiment, the controller 30 determines whether the atmospheric pressure around the shovel is lower than a predetermined pressure based on an output of the atmospheric pressure senor P1 mounted on the shovel.

Then, if it is determined that the above-mentioned condition is satisfied (YES in step S11), the controller 30 performs the process of steps S12 and S13. On the other hand, if it is determined that the above-mentioned condition is not satisfied (NO in step S11), the controller 30 performs the process of step S14. Thereby, the controller 30 can achieve the same effect as the supercharging pressure increasing process of FIG. 5.

Additionally, in the present embodiment using the output of the atmospheric pressure sensor P1, the controller 30 may determine the supercharging pressure increasing time nozzle opening degree As in response to a magnitude of the atmospheric pressure. That is, the controller 30 may control the rotating speed of the supercharger 25 before a hydraulic load is applied to the engine 11 in response to a magnitude of the atmospheric pressure. Specifically, the controller 30 decreases the supercharging pressure increasing time nozzle opening degree As as the atmospheric pressure decreases. In this case, the controller 30 may set the supercharging pressure increasing time nozzle opening degree As stepwisely in response to a magnitude of the atmospheric pressure, or may set the supercharging pressure increasing time nozzle opening degree As steplessly. According to such a structure, the controller 30 can control a magnitude of the nozzle opening degree stepwisely or steplessly after the decrease in the waiting mode, thereby further suppressing a waste energy consumption.

Figure 8:
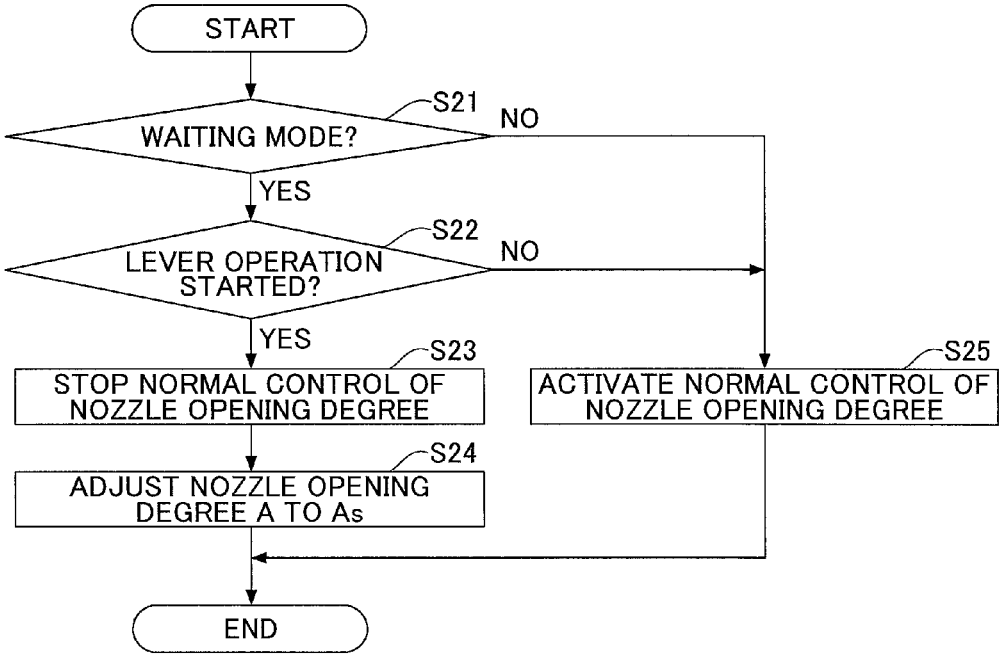
FIG. 8 is a flowchart of a further supercharging pressure increasing process.

A description is given, with reference to FIG. 8, of a further example of the supercharging pressure increasing process according to the present embodiment. FIG. 8 is a flowchart of a further example of the supercharging pressure increasing process according to the present embodiment. In the supercharging pressure increasing process illustrated in FIG. 8, the nozzle opening degree of the nozzle vanes 25*a* is temporarily decreased at a time of starting a lever operation irrespective of a magnitude of the atmospheric pressure. Thus, the switch 50 is omitted in the present embodiment, and the controller 30 is capable of always effectively activating the supercharging pressure increase necessity determining part 300 and the supercharging pressure controlling part 301. However, the switch 50 or the atmospheric pressure sensor P1 may be used to activate the supercharging pressure increasing process according to the present embodiment only in the case where the atmospheric pressure is relatively low.

First, the supercharging pressure increase necessity determining part 300 determines whether the shovel is in the waiting mode (step S21). In the present embodiment, the supercharging pressure increase necessity determining part 300 determines whether the shove is in the waiting mode based on whether the discharge pressure of the main pump 14 is higher than or equal to a predetermined pressure.

If the supercharging pressure increase necessity determining part 300 determines that the shovel is in the waiting mode (no hydraulic load exists) (YES in step S21), the controller determines whether a lever operation has been started (step S22). In the present embodiment, the controller 30 determines whether the lever operation has been started based on the output of the pressure sensor 29.

If it is determined that a lever operation has been started (YES in step S22), the controller 30 stops the normal control of the nozzle opening degree (step S23). Then, the controller 30 activates the supercharging pressure increasing control of the nozzle opening degree to adjust the nozzle opening degree of the nozzle vanes 25*a* to the supercharging pressure increasing time nozzle opening degree As, which is smaller than the nozzle opening degree in the normal control (step S24).

On the other hand, if it is determined that a lever operation has not been started (NO in step S22), the controller 30 activates the normal control of the nozzle opening degree without activating the supercharging pressure increasing process of the nozzle opening degree (step S25). This is to adjust the nozzle opening degree of the nozzle vanes 25*a* to a nozzle opening degree corresponding to an engine revolution speed.

Moreover, if the supercharging pressure increase necessity determining part 300 determines that the shovel is not in the waiting mode (no hydraulic load exists) (NO in step S21), that is, for example, if the supercharging pressure increase necessity determining part 300 determines that the discharge pressure of the main pump 14 is higher than or equal to a predetermined pressure, the controller 30 activates the normal control of the nozzle opening degree without activating the supercharging pressure increasing process of the nozzle opening degree or by causing the supercharging pressure increasing control of the nozzle opening degree to stop (step S25).

It should be noted that the supercharging pressure increase necessity determining part 300 may determines whether the shovel is in the waiting mode based on whether the discharge pressure of the main pump 14 is higher than or equal to the predetermined pressure or whether a predetermined time has passed after stopping the normal control of the nozzle opening degree or a combination of aforementioned.

In this way, when a lever operation is started, the controller 30 temporarily increases the nozzle opening degree of the nozzle vanes 25*a*. Thus, even when a hydraulic load due to an external force has not been generated yet, the controller 30 can increase the supercharging pressure of the variable nozzle turbo 25. That is, the supercharging pressure can be increased by a predetermined pressure range prior to an increase in the hydraulic load due to an external force. As a result, even when a hydraulic load due to an external force sharply increases, the variable nozzle turbo 25 can generate a supercharging pressure corresponding to a hydraulic load (engine load), which increases in response to the external load, before a decrease in the engine revolution speed or before the engine stop. It should be noted that, when the increase in the supercharging pressure cannot follow the increase in the hydraulic load (engine load) due to an external force, the engine 11 cannot sufficiently increase the fuel injection amount, which results in a decrease in the engine revolution speed, and there may be a case in which the engine 11 stops as a result that the engine revolution speed cannot be increased.

Figure 9:
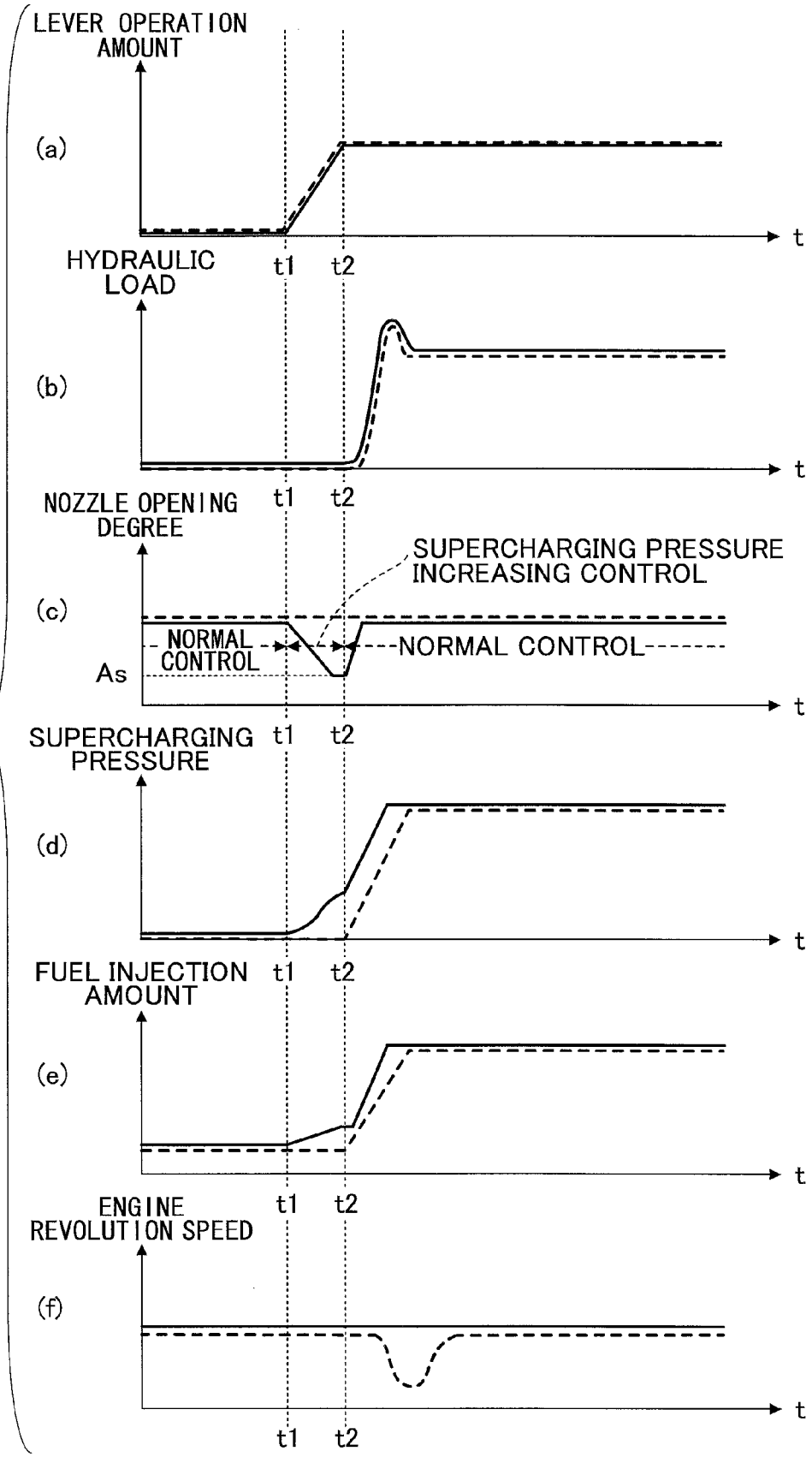
FIGS. 9(*a*)-9(*f*) are time charts of temporal transitions of various physical amounts when performing the supercharging pressure increasing process illustrated in FIG. 8.

A description is given below, with reference to FIGS. 9(*a*)-9(*f*), of temporal transitions of various physical amounts in a case of performing the supercharging pressure increasing process of FIG. 8. FIGS. 9(*a*)-9(*f*) are time charts for illustrating various physical amounts. FIG. 9(*a*) illustrates a temporal transition of an amount of lever operation, 9(*b*) illustrates a temporal transition of a hydraulic load (absorbing horsepower), 9(*c*) illustrates a temporal transition of a nozzle opening degree, 9(*d*) illustrates a temporal transition of a supercharging pressure, 9(*e*) illustrates a temporal transition of a fuel injection amount, and 9(*f*) illustrates a temporal transition of an engine revolution speed. The transitions indicated by dashed lines in FIGS. 9(*a*)-9(*f*) illustrate transitions when the supercharging pressure increasing process of FIG. 8 is not performed.

In the present embodiment, it is assumed that a lever operation starts to move the arm 5 at time t1 in order to perform, for example, an excavating operation.

First, for the sake of comparison, a description is given of the temporal transitions of the various physical amounts when the supercharging pressure increasing process of FIG. 8 is not performed. It should be noted that the temporal transition of the lever operation amount of the aim operation lever is that same as the case of FIGS. 6(*a*)-6(*g*), and a description thereof will be omitted.

If the supercharging pressure increasing process of FIG. 8 is not performed, the hydraulic load is maintained at the same level without increasing until time t2 is reached. Thereafter, at time t2, the arm 5 is brought into contact with the ground and the hydraulic load is increased in response to an increase in a reaction force of the excavating operation.

The supercharging pressure is also maintained without being increased until time t2 is reached, and is at a relatively low state at time t2. Thus, the variable nozzle turbo 25 cannot cause the increase in the supercharging pressure to follow the increase in the hydraulic load after time t2. As a result, the engine 11 cannot sufficiently increase the fuel injection amount, which results in a shortage of engine output. Accordingly, the engine revolution speed is decreased without being maintained at the fixed speed, and, there may be a case where the engine 11 stops without an increase in the engine revolution speed.

On the other hand, if the supercharging pressure increasing process of FIG. 8 is performed, the nozzle opening degree of the nozzle vanes 25*a* starts to increase at time t1 and reaches a predetermined level before time t2 is reached (refer to FIG. 9(*d*)). Thus, the variable nozzle turbo 25 can increase the supercharging pressure after time t2 without a large delay in increasing the hydraulic load. As a result, the engine 11 can maintain the engine revolution speed without generating a shortage of engine output.

Additionally, when the hydraulic load of the main pump 14 rises at time t2, the controller 30 determines that the shovel is not in the waiting mode, and stops the supercharging pressure increasing control of the nozzle opening degree and activates the normal control. As a result, the nozzle opening degree is controlled to a value corresponding to the engine revolution speed. It should be noted that although the nozzle opening degree in the normal control time is illustrated as a transition at a fixed value in FIGS. 9(*a*)-9(*f*) for the sake of clarification, the nozzle opening degree varies in practice in response to the engine revolution speed or the like.

As mentioned above, the controller 30 causes the supercharging pressure to increase to a relatively high level by decreasing the nozzle opening degree of the nozzle vanes 25*a* after a lever operation starts and before the hydraulic load due to an external force such as a reaction force of an excavating operation increases. As a result, the controller 30 can rapidly increase the supercharging pressure, which is already at a relatively high level, even when the hydraulic load due to an external force such as a reaction force of an excavating operation shapely increases. Moreover, when increasing the supercharging pressure, the controller 30 does not cause a decrease in the engine revolution speed (decrease in a workability) or cause the engine 11 to stop.

Figure 10:
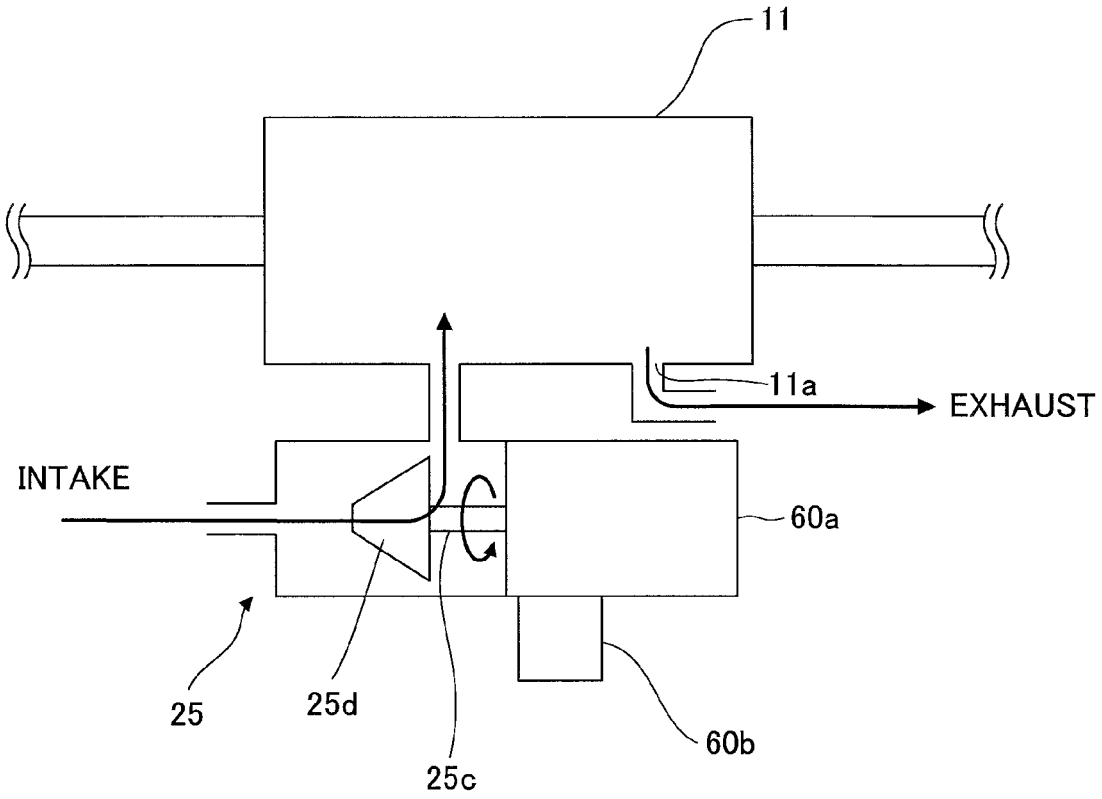
FIG. 10 is an illustration of another structure of the supercharger.

In the above-mentioned embodiment, the compressor blades 25*d* rotates together with the turbine blades 25*b*, which rotate by receiving exhaust gas of the engine 11, to cause an atmospheric air to flow into an intake port of the engine 11. However, the present invention is not limited to such a structure. The rotation of the compressor blades 25*d* may be controlled by a supercharger electric motor 60*a* as illustrated in FIG. 10. Specifically, the supercharger electric motor 60*a* changes a rotating speed of the supercharger 25 in response to a control signal from a supercharging pressure adjusting part 60*b*, which corresponds to the nozzle actuator 60 illustrated in FIGS. 4A and 4B. In this case, the exhaust gas passing through the exhaust port 11*a* of the engine 11 is not required to rotate the turbine blades 25*b*.

Moreover, although the discharge amount of the main pump 14 is controlled based on the negative control in the above-mentioned embodiments, the discharge amount may be controlled based on a positive control, a load sensing control, etc.

Moreover, although the turning mechanism 2 is of a hydraulic drive type in the above-mentioned embodiment, the turning mechanism 2 may be an electric drive type.

Furthermore, although the example in which the main pump 14 is driven by the engine 11 alone was explained in the above-mentioned embodiment, the main pump 14 can be connected with both the engine 11 and a motor generator to drive the main pump 14 together. In such a case, the shovel can convert a rotating power into electric energy by the motor generator and accumulate the electric energy in an accumulating device. Further, the electric energy accumulated in the accumulating device may be converted into a rotating power by the motor generator to drive the main pump 14.

The present invention is not limited to the specifically disclosed embodiments using the above-mentioned shovel as an example, and various variations and modifications may be made without departing from the scope of the present invention.

What is claimed is:

1. A shovel comprising:

a boom cylinder that drives a boom;

an arm cylinder that drives an arm;

a hydraulic pump that supplies operating oil to the boom cylinder and the arm cylinder;

an engine connected to the hydraulic pump and equipped with a supercharger, the engine being controlled to maintain a revolution speed within a certain definite range; and a controller that controls a rotating speed of the supercharger, wherein the controller performs a process of increasing the rotating speed of the supercharger so as to increase a supercharging pressure generated by the supercharger before a hydraulic load is applied to the engine.

2. The shovel as claimed in claim 1, wherein the supercharger is a variable nozzle turbocharger, and the controller causes the rotating speed of the supercharger to increase before a hydraulic load is applied to the engine by decreasing a nozzle opening degree of a variable nozzle provided in the variable nozzle turbocharger.

3. The shovel as claimed in claim 1, further comprising an electric motor provided to the supercharger to control the rotating speed of the supercharger.

4. The shovel as claimed in claim 1, further comprising a switch that changes an adjusting function of adjusting the rotating speed of the supercharger, before a hydraulic load is applied to the engine, between an activated state and a stopped state.

5. The shovel as claimed in claim 1, wherein the controller controls the rotating speed of the supercharger before a hydraulic load is applied to the engine in response to a magnitude of an atmospheric pressure.

6. The shovel as claimed in claim 1, wherein the controller starts an adjustment of the rotating speed of the supercharger, before a hydraulic load is applied to the engine, in response to a lever operation applied to an operation device to operate hydraulic actuators including the boom cylinder and the arm cylinder.

7. The shovel as claimed in claim 1, wherein the controller is configured to detect a waiting mode of the shovel and increase the supercharging pressure upon detecting the waiting mode of the shovel.

8. The shovel as claimed in claim 7, wherein the controller is configured to increase the supercharging pressure and perform a negative controlling simultaneously upon detecting the waiting mode of the shovel.

9. The shovel as claimed in claim 7, further comprising an atmospheric pressure sensor configured to detect an atmospheric pressure and output a detected value to the controller, wherein the controller is configured to increase the supercharging pressure upon detecting the atmospheric pressure below a predetermined value by the atmospheric pressure sensor and detecting the waiting mode of the shovel by the controller.

10. The shovel as claimed in claim 7, wherein the waiting mode is a state where the boom cylinder and the arm cylinder are not operated so that no load is applied to the shovel.

11. The shovel as claimed in claim 7, wherein the controller is further configured to detect an operation signal of an operation device of the shovel, and to increase the supercharging pressure upon detecting both of the detection of the waiting mode of the shovel and the operation signal.

* * * * *